US009805920B2

(12) United States Patent
Kenny

(10) Patent No.: US 9,805,920 B2
(45) Date of Patent: Oct. 31, 2017

(54) DYNAMIC RESOLUTION CORRECTION OF QUADRUPOLE MASS ANALYSER

(71) Applicant: Micromass UK Limited, Wilmslow (GB)

(72) Inventor: Daniel James Kenny, Knutsford (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 15/137,569

(22) Filed: Apr. 25, 2016

(65) Prior Publication Data

US 2016/0240359 A1 Aug. 18, 2016

Related U.S. Application Data

(63) Continuation of application No. 14/003,176, filed as application No. PCT/GB2012/050506 on Mar. 7, 2012, now Pat. No. 9,324,543.

(Continued)

(30) Foreign Application Priority Data

Mar. 7, 2011 (GB) ..... 1103854.4

(51) Int. Cl.

| | |
|---|---|
| ***H01J 49/00*** | (2006.01) |
| ***H01J 49/42*** | (2006.01) |
| ***H01J 49/40*** | (2006.01) |

(52) U.S. Cl.

CPC ..... *H01J 49/0009* (2013.01); *H01J 49/0031* (2013.01); *H01J 49/40* (2013.01); *H01J 49/4215* (2013.01)

(58) Field of Classification Search

CPC .... H01J 49/0009; H01J 49/0031; H01J 49/40; H01J 49/4215

See application file for complete search history.

(56) References Cited

U.S. PATENT DOCUMENTS 3,413,463 A * 11/1968 Brubaker ..... H01J 49/4215 250/290
3,784,814 A * 1/1974 Sakai ..... H01J 49/429 250/290

(Continued)

FOREIGN PATENT DOCUMENTS

JP S 513238 2/1976
JP H 5121040 5/1993

(Continued)

OTHER PUBLICATIONS

Hübschmann, H "Mass Calibration" Handbook of GC/MS, 2009.*

(Continued)

*Primary Examiner* — Wyatt Stoffa

(74) *Attorney, Agent, or Firm* — Diederiks & Whitelaw, PLC

(57) ABSTRACT

A method of mass spectrometry is disclosed comprising automatically correcting the mass or mass to charge ratio resolution of a quadrupole mass filter or mass analyser one or more times during an experimental run or acquisition based upon a measurement, determination or estimation of the mass or mass to charge ratio resolution of one or more reference ions observed in a mass spectrum or mass spectral data acquired either during the same experimental run or acquisition or during a previous experimental run or acquisition.

14 Claims, 3 Drawing Sheets

Related U.S. Application Data

(60) Provisional application No. 61/476,859, filed on Apr. 19, 2011.

(56) References Cited

U.S. PATENT DOCUMENTS 4,189,640 A * 2/1980 Dawson ..... B01D 59/44 250/290
4,804,839 A * 2/1989 Broadbent ..... G01N 30/7206 250/281
4,837,434 A * 6/1989 James ..... G01N 30/72 250/281
5,089,703 A * 2/1992 Schoen ..... H01J 49/4285 250/281
5,182,451 A * 1/1993 Schwartz ..... H01J 49/424 250/282
5,248,875 A * 9/1993 Douglas ..... H01J 49/005 250/281
5,354,988 A * 10/1994 Jullien ..... H01J 49/022 250/282
5,397,894 A * 3/1995 Wells ..... H01J 49/0009 250/282
5,559,325 A * 9/1996 Franzen ..... H01J 49/4265 250/282
6,153,880 A * 11/2000 Russ, IV ..... H01J 49/4215 250/292
6,177,668 B1 * 1/2001 Hager ..... H01J 49/004 250/281
6,188,064 B1 * 2/2001 Koster ..... H01J 49/0036 250/281
6,191,417 B1 * 2/2001 Douglas ..... H01J 49/004 250/281
6,194,716 B1 * 2/2001 Takada ..... H01J 49/0009 250/252.1
6,518,581 B1 * 2/2003 Dheandhanoo ..... H01J 49/0422 250/281
6,979,816 B2 12/2005 Tang et al.
6,983,213 B2 * 1/2006 Wang ..... G06K 9/00496 250/282
7,034,287 B2 4/2006 Okumura et al.
7,183,545 B2 * 2/2007 Wang ..... H01J 49/421 250/281
7,202,473 B2 4/2007 Bateman et al.
7,372,042 B2 5/2008 Mordehai et al.
7,629,575 B2 * 12/2009 Wells ..... H01J 49/4265 250/281
7,642,511 B2 1/2010 Reilly
8,073,635 B2 * 12/2011 Thomson ..... H01J 49/0009 702/23
8,101,908 B2 1/2012 Senko
8,193,490 B2 6/2012 Jertz et al.
8,304,720 B2 11/2012 Senko et al.
8,445,844 B2 5/2013 Mukaibatake et al.
8,653,451 B2 * 2/2014 Satoh ..... H01J 49/403 250/282
8,748,811 B2 6/2014 Okumura
2004/0164240 A1 8/2004 Okumura et al.
2004/0188605 A1 * 9/2004 Tang ..... H01J 49/066 250/288
2005/0023454 A1 * 2/2005 Bateman ..... H01J 49/0036 250/288
2007/0045531 A1 * 3/2007 Mordehai ..... H01J 43/06 250/285
2007/0075239 A1 * 4/2007 Ding ..... H01J 49/429 250/282
2007/0205361 A1 * 9/2007 Russ ..... H01J 49/0009 250/288
2008/0203288 A1 * 8/2008 Makarov ..... H01J 49/004 250/282
2008/0237458 A1 * 10/2008 Wang ..... H01J 49/0009 250/282
2008/0251711 A1 * 10/2008 Reilly ..... H01J 49/067 250/282
2009/0159791 A1 * 6/2009 Wells ..... H01J 49/4265 250/282
2009/0272898 A1 * 11/2009 Senko ..... H01J 49/423 250/290
2010/0019144 A1 * 1/2010 Schwartz ..... H01J 49/4265 250/283
2010/0193684 A1 * 8/2010 Mukaibatake ..... H01J 49/022 250/292
2010/0207020 A1 * 8/2010 Jertz ..... H01J 49/38 250/282
2010/0276583 A1 * 11/2010 Senko ..... H01J 49/427 250/282
2010/0280764 A1 * 11/2010 Thomson ..... H01J 49/0009 702/23
2010/0301205 A1 * 12/2010 Thomson ..... H01J 49/0045 250/283
2012/0068061 A1 * 3/2012 Griffin ..... G01N 1/24 250/282
2012/0309027 A1 * 12/2012 Anderson ..... G01N 33/6851 435/7.21
2013/0214146 A1 * 8/2013 Okumura ..... H01J 49/0009 250/281

FOREIGN PATENT DOCUMENTS

JP H5121040 A * 5/1993
WO 2007/130649 11/2007

OTHER PUBLICATIONS

Hübschmann, "*Mass Calibration*" Handbook of GC/MS, pp. 261-269, 2009.
"*Quality Management Systems—Requirements*", vol. 4, pp. i-28, 2008.

* cited by examiner

DYNAMIC RESOLUTION CORRECTION OF QUADRUPOLE MASS ANALYSER

CROSS-REFERENCE TO RELATED APPLICATION

This application is a continuation application of U.S. patent application Ser. No. 14/003,176 filed on 4 Sep. 2013 which represents a National Stage application of PCT/GB2012/050506 entitled "Dynamic Resolution Correction of Quadrupole Mass Analyser" filed 7 Mar. 2012 which claims priority from and the benefit of U.S. Provisional Patent Application Ser. No. 61/476,859 filed on 19 Apr. 2011 and United Kingdom Patent Application No. 1103854.4 filed on 7 Mar. 2011. The entire contents of these applications are incorporated herein by reference.

BACKGROUND TO THE INVENTION

The present invention relates to a method of correcting resolution drift of a quadrupole rod set mass analyser, a method of mass spectrometry and a mass spectrometer.

The resolution and mass accuracy of a quadrupole mass spectrometer ("QMS") is susceptible to environmental factors such as temperature and humidity. When operated at unit mass resolution (approximately 0.7 Da FWHM) the resolution and mass position drift of modern QMS instruments is tolerable but at higher resolutions (e.g. 0.05 to 0.2 Da) the same degree of drift can become unacceptable.

It is known to use an external calibrant or reference compound which is commonly referred to as a "lock mass" to correct the mass accuracy of a Time of Flight ("ToF") mass analyser.

However, as will be understood by those skilled in the art, mass accuracy is quite different from mass resolution.

It is desired to provided an improved method of mass spectrometry and mass spectrometer.

SUMMARY OF THE INVENTION

According to an aspect of the present invention there is provided a method of mass spectrometry comprising:

providing a quadrupole mass filter or mass analyser; and automatically correcting the mass or mass to charge ratio resolution of the quadrupole mass filter or mass analyser one or more times during an experimental run or acquisition based upon a measurement, determination or estimation of the mass or mass to charge ratio resolution of one or more reference ions observed in a mass spectrum or mass spectral data acquired either during the same the experimental run or acquisition or during a previous experimental run or acquisition.

The method preferably further comprises automatically sampling one or more reference ions using the quadrupole mass filter or mass analyser one or more times during the experimental run or acquisition.

The method preferably further comprises automatically measuring, determining or estimating the mass or mass to charge ratio resolution of the one or more reference ions observed in a mass spectrum or mass spectral data during the experimental run or acquisition.

The step of automatically correcting the mass or mass to charge ratio resolution of the quadrupole mass filter or mass analyser preferably comprises automatically altering the resolving DC offset and/or the gain of the quadrupole mass filter or mass analyser.

The step of automatically correcting the mass or mass to charge ratio resolution of the quadrupole mass filter or mass analyser may comprise automatically altering the energy of ions passing to the quadrupole mass filter or mass analyser.

The step of automatically correcting the mass or mass to charge ratio resolution of the quadrupole mass filter or mass analyser may comprise automatically altering one or more voltages applied to a pre-filter arranged upstream of the quadrupole mass filter or mass analyser.

The step of automatically correcting the mass or mass to charge ratio resolution of the quadrupole mass filter or mass analyser may comprise automatically altering one or more voltages applied to a post-filter arranged downstream of the quadrupole mass filter or mass analyser.

The method may further comprise providing a first ion source for generating analyte ions and providing a second different ion source for generating the one or more reference ions.

The second ion source preferably comprises either an atmospheric pressure ion source or a sub-atmospheric pressure ion source, wherein the sub-atmospheric pressure ion source is located within a vacuum chamber of a mass spectrometer.

The one or more reference ions may be either exogenous or endogenous to a sample being analysed.

The method preferably further comprises correcting the mass position, mass accuracy or recalibrating or realigning the mass or mass to charge ratio of mass spectral data.

The step of correcting the mass position, mass accuracy or recalibrating or realigning the mass or mass to charge ratio of mass spectral data preferably comprises reducing any difference between the mass or mass to charge ratio of the one or more reference ions as presented in a mass spectrum or mass spectral data and the known mass or mass to charge ratio of the one or more reference ions.

The step of correcting the mass position, mass accuracy or recalibrating or realigning the mass or mass to charge ratio of mass spectral data may be performed dynamically during an experimental run or acquisition and may comprise automatically varying one or more voltages applied to the quadrupole mass filter or mass analyser.

Alternatively, the step of correcting the mass position, mass accuracy or recalibrating or realigning the mass or mass to charge ratio of mass spectral data may be performed as an automatic post-processing step.

The method preferably further comprises acquiring further mass spectral data to confirm that the step of correcting the mass position, mass accuracy or recalibrating or realigning the mass or mass to charge ratio of mass spectral data was successful.

The method preferably further comprises acquiring further mass spectral data to confirm that the step of automatically correcting the mass or mass to charge ratio resolution of the quadrupole mass filter or mass analyser was successful.

The further mass spectral data is preferably used to further correct the mass or mass to charge ratio resolution of the quadrupole mass filter or mass analyser.

The further mass spectral data is preferably used to further correct the mass position, mass accuracy or recalibrate or realign the mass or mass to charge ratio of mass spectral data.

According to an aspect of the present invention there is provided a mass spectrometer comprising:

a quadrupole mass filter or mass analyser; and a control system arranged and adapted:

(i) to correct the mass or mass to charge ratio resolution of the quadrupole mass filter or mass analyser one or more times during an experimental run or acquisition based upon a measurement, determination or estimation of the mass or mass to charge ratio resolution of one or more reference ions observed in a mass spectrum or mass spectral data acquired either during the same the experimental run or acquisition or during a previous experimental run or acquisition.

According to an aspect of the present invention there is provided a method of mass spectrometry comprising:

automatically sampling one or more reference ions using a quadrupole mass filter or mass analyser one or more times during an experimental run or acquisition;

automatically measuring the mass or mass to charge ratio resolution of the one or more reference ions during the experimental run or acquisition; and automatically correcting the mass or mass to charge ratio resolution of the quadrupole mass filter or mass analyser one or more times during the experimental run or acquisition.

According to an aspect of the present invention there is provided a mass spectrometer comprising:

a quadrupole mass filter or mass analyser; and a control system arranged and adapted:

(i) to sample one or more reference ions using the quadrupole mass filter or mass analyser one or more times during an experimental run or acquisition;

(ii) to measure the mass or mass to charge ratio resolution of the one or more reference ions during the experimental run or acquisition; and (iii) to correct the mass or mass to charge ratio resolution of the quadrupole mass filter or mass analyser one or more times during the experimental run or acquisition.

According to an aspect of the present invention there is provided a method of correcting mass or mass to charge ratio resolution drift of a quadrupole mass filter or mass analyser, the method comprising:

automatically measuring a parameter during an experimental run; and automatically correcting the mass or mass to charge ratio resolution of the quadrupole mass filter or mass analyser one or more times during the experimental run or acquisition in response to the measured parameter.

The parameter preferably comprises an environmental parameter.

According to an embodiment the parameter may comprise temperature and/or humidity and/or ion current and/or space charge.

According to an embodiment the parameter may comprise a signal output from an electronic control unit.

According to an aspect of the present invention there is provided a mass spectrometer comprising:

a quadrupole mass filter or mass analyser; and a control system arranged and adapted:

(i) to measure a parameter during an experimental run; and (ii) to correct the mass or mass to charge ratio resolution of the quadrupole mass filter or mass analyser one or more times during the experimental run or acquisition in response to the measured parameter.

The parameter preferably comprises temperature and/or humidity and/or ion current and/or space charge.

According to an aspect of the present invention there is provided a method of mass spectrometry comprising:

automatically correcting the mass or mass to charge ratio resolution of a quadrupole mass filter or mass analyser one or more times during an experimental run or acquisition in response to mass spectral data obtained during the current or a previous experimental run or acquisition.

According to an aspect of the present invention there is provided a mass spectrometer comprising:

a quadrupole mass filter or mass analyser; and a control system arranged and adapted:

(i) to correct the mass or mass to charge ratio resolution of the quadrupole mass filter or mass analyser one or more times during an experimental run or acquisition in response to mass spectral data obtained during the current or a previous experimental run or acquisition.

It is not known to tune automatically the mass or mass to charge ratio resolution of a mass analyser, particularly a quadrupole rod set mass analyser, during an experiment or a single acquisition so as to correct for mass or mass to charge ratio resolution drift or other induced changes in the mass or mass to charge ratio resolution.

It is also not known to use a lock mass on a quadrupole to correct for mass accuracy.

The preferred embodiment relates to a method of automatically correcting resolution drift and/or mass (or mass to charge ratio) position drift during an experiment or a series of experiments. According to the preferred embodiment a method of automatic dynamic resolution correction for a quadrupole mass filter or mass analyser is provided.

According to an embodiment of the present invention a mass spectrometer comprising a quadrupole mass filter or mass analyser is preferably provided. A lock mass is preferably automatically sampled intermittently or one or more times at the start of and/or during the course of an experiment.

The mass resolution of the known lock mass(es) is preferably automatically measured or determined and appropriate corrections are preferably made to one or more ion-optical components in a dynamic and automatic manner. According to the preferred embodiment the ion-optical component which is preferably adjusted comprises a quadrupole mass filter or mass analyser and the control system may be arranged and adapted to alter either the resolving DC offset and/or the gain of the quadrupole mass filter or mass analyser.

According to the preferred embodiment the resolution of the quadrupole mass filter or mass analyser is preferably improved or increased in an automatic manner.

Once a correction has been made to an ion-optical component such as a quadrupole mass filter or mass analyser, a second or further lock mass dataset may then be acquired. The second or further dataset may be used to confirm that the resolution correction was successful. The second or further dataset may also be used to further correct the mass resolution and/or to recalibrate or further recalibrate the mass scale.

According to another embodiment a parameter other than mass resolution may be measured. For example, according to an embodiment the temperature and/or humidity of the environment surrounding a quadrupole mass filter or mass analyser may be measured. The resolution of the ion-optical component such as a quadrupole may then be corrected based upon the known response of the instrument to a change in the measured parameter. Preferably, mass data is also analysed and the resolution of the quadrupole mass filter or mass analyser is also preferably improved or increased based upon the mass data.

According to an embodiment the measured parameter may be humidity or a readback from an electronic control unit. According to other embodiments the parameter may be another environmental parameter.

Lockmass or calibration ions may be provided either by: (i) doping the sample being analysed with one or more species of lockmass, reference or calibration ions; (ii) providing a second ion source (e.g. a second Electrospray ion source) wherein lockmass, reference or calibration ions are provided to the second ion source and are then received by the mass spectrometer via the same ion inlet orifice as analyte ions emitted from a first ion source; (iii) providing a second ion source wherein lockmass, reference or calibration ions enter the mass spectrometer via a different ion inlet orifice to that of analyte ions; and (iv) providing a low-pressure ion source such as a Glow Discharge ion source within a vacuum chamber of the mass spectrometer and wherein the low-pressure ion source is arranged to produce lockmass, reference or calibration ions.

According to an embodiment of the present invention there is provided a method of operating a mass spectrometer wherein immediately prior to or during an experiment, a known reference compound is automatically analysed to determine the existing or current mass resolution of the mass spectrometer. The mass spectrometer is then preferably automatically corrected or adjusted to give the desired mass resolution for the subsequent experiment.

According to an embodiment lockmass, reference or calibration ions may be mass analysed by a quadrupole mass filter or mass analyser. If the mass or mass to charge ratio of the lockmass, reference or calibration ions is determined to be different from that expected thereby suggesting that the mass or mass to charge ratio of ions analysed by the quadrupole mass analyser needs to be recalibrated, then according to a less preferred embodiment a real time or dynamic change to the quadrupole mass analyser may be made to correct the mass accuracy. For example, a real time change to the DC offset and/or gain of the quadrupole mass analyser may be made in order to correct the mass accuracy. According to another embodiment, the mass analysis of the lockmass, reference or calibration ions may be used to post-process mass spectral data obtained and to recalibrate the mass or mass to charge ratio of the mass analysed ions thereby correcting the mass accuracy.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
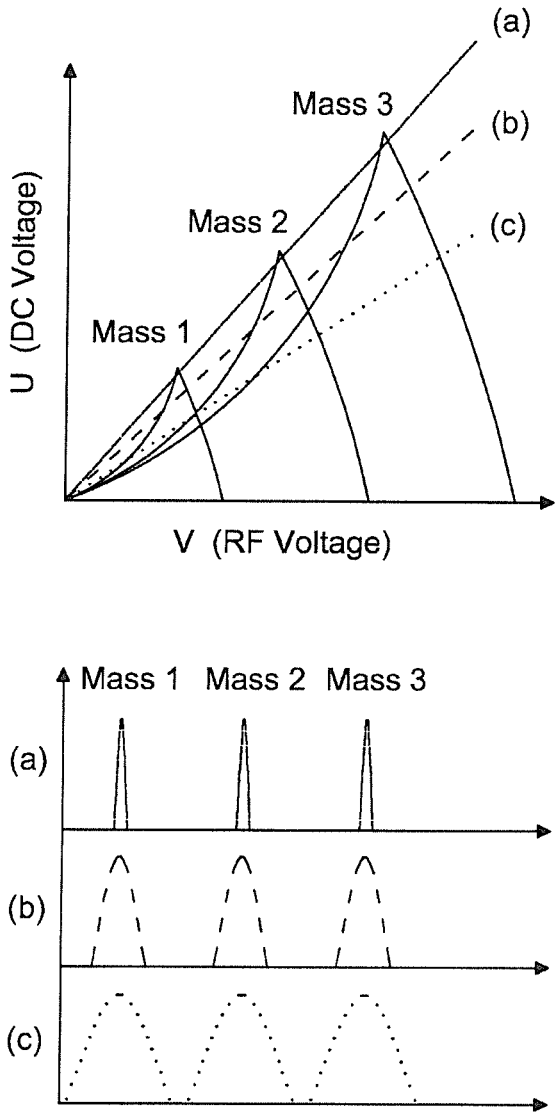
FIG. 1 illustrates three different scan lines for a quadrupole mass filter or mass analyser and the corresponding mass resolution of mass peaks when the quadrupole follows the different scan lines.

FIG. 1 illustrates stability diagrams for three ions (having three different mass to charge ratios) within a quadrupole rod set mass filter/analyser. The three different ions are observed as three mass peaks (Mass 1, Mass 2, Mass 3) in corresponding mass spectra.

FIG. 1 also shows three different scan lines (a), (b) and (c) for the quadrupole mass filter/analyser. The scan lines (a), (b) and (c) illustrate different instrument settings for the quadrupole mass filter/analyser. FIG. 1 also shows the profile of resulting mass peaks which are obtained for each of the different scan lines (a), (b) and (c). It will be apparent that the mass resolution of the mass peaks observed in a mass spectrum is dependent upon the scan line which is followed and hence is dependent upon the instrument setting of the quadrupole mass filter/analyser.

The three overlapping stability diagrams for the three different mass peaks which are shown in FIG. 1 comprise three regions which represent those areas which correspond to stable solutions to Mathieu's differential equation and hence represent solutions wherein ions have a stable trajectory through the quadrupole mass analyser. The three scan lines (a), (b) and (c) are indicated by dashed lines.

It will be apparent that scan line (a) intersects the three regions representing stable trajectory so that there is only a small region above the scan line (a). Scan line (a) illustrates a mode of operation wherein the quadrupole mass filter/analyser is being operated in a narrow bandpass mode of operation. As a result, the resulting mass resolution as illustrated by the sharp peak shapes in FIG. 1(*a*) will be high.

Scan line (b) has a lower gradient that scan line (a) and intersects the three regions so that there is a larger region above the scan line (b) compared with the situation with scan line (a). Scan line (b) illustrates a mode of operation wherein the quadrupole mass filter/analyser is being operated in a wider bandpass mode of operation compared with scan line (a). The resulting mass resolution as illustrated by the wider peak shapes in FIG. 1(*b*) indicates that the mass resolution is lower than that obtained when scan line (a) is followed.

Scan line (c) has a lower gradient that scan line (b) and intersects the three regions so that there is a larger region above the scan line (c) compared with the situation with scan line (b). Scan line (c) illustrates a mode of operation wherein the quadrupole mass filter/analyser is being operated in a wider bandpass mode of operation compared with scan line (b). The resulting mass resolution as illustrated by the wider peak shapes in FIG. 1(*c*) indicates that the mass resolution is lower than that obtained when scan line (b) is followed.

It will be understood that the scan lines (a), (b) and (c) shown in FIG. 1 have been exaggerated in order to illustrate aspects of the present invention.

According to a preferred embodiment of the present invention lock mass, reference or calibration ions are periodically sampled and mass analysed by a quadrupole rod set mass analyser. A control system is arranged to analyse (e.g. by peak shape matching or profiling) the resolution of the mass or ion peaks observed in a mass spectrum or more generally in mass spectral data. The control system then determines the effective (instantaneous) resolution of the quadrupole mass filter or mass analyser. The control system then preferably alters one or more parameters of the quadrupole mass filter or mass analyser in order to maximise the resolution of the quadrupole mass filter or mass analyser. According to an embodiment the quadrupole mass filter or mass analyser is arranged to alter the ratio of the DC voltage to the RF voltage applied to the quadrupole mass filter/analyser. Varying the ratio of the DC voltage to the RF voltage applied to the quadrupole mass filter/analyser can have the effect of either altering the intercept of the scan lines shown in FIG. 1 and/or altering the gradient of the scan lines shown in FIG. 1. According to the preferred embodiment the intercept and/or gradient of the scan lines are altered so as to ensure that the mass or mass to charge ratio resolution of the quadrupole is set or maintained as high as possible.

The preferred embodiment is therefore particularly advantageous in that the control system of a mass spectrometer preferably repeatedly monitors the resolution of a quadrupole mass filter/analyser during an experimental acquisition and preferably automatically and dynamically ensures that the resolution of the quadrupole mass filter/analyser is maintained as high as possible and is effectively prevented from drifting during an acquisition or between acquisitions.

Figure 2:
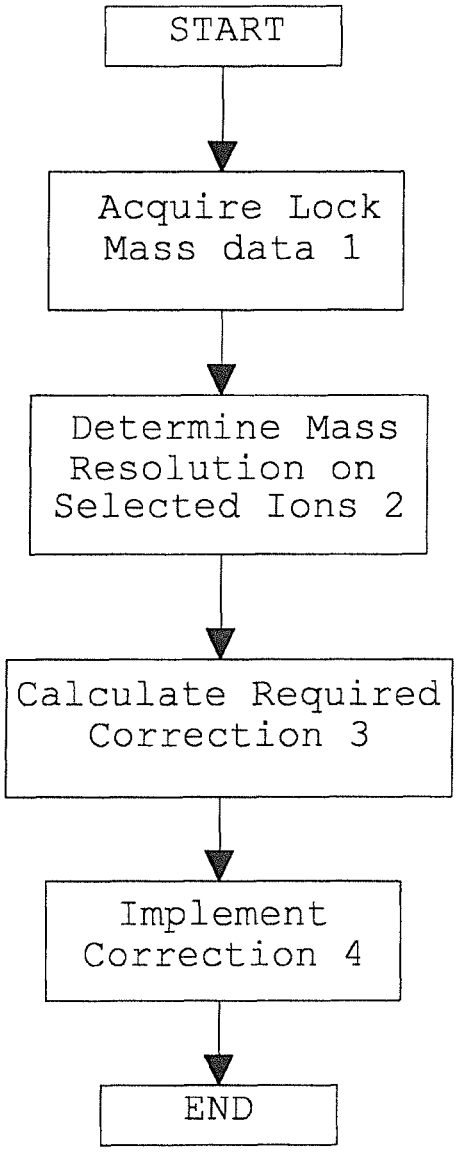
FIG. 2 shows a flow chart illustrating the process of correcting the mass resolution of a quadrupole mass analyser in real time.

An embodiment of the present invention will now be described with reference to the flow chart shown in FIG. 2 which details the steps followed in a basic mass resolution correction method. According to the preferred embodiment lock mass data is acquired as a first step 1. The acquisition of lock mass data preferably involves sampling lockmass, reference or calibration ions using a quadrupole rod set mass analyser. The mass resolution of the lockmass, reference or calibration ions is then determined in a second step 2. For example, the profile of one or more ion or mass peaks in a mass spectrum or mass spectral data may be analysed by peak matching techniques and the resolution of the ion or mass peaks may be determined. If it is determined that the resolution of the quadrupole mass filter/analyser is sub-optimal, then a required correction is preferably calculated as a third step 3 and the correction is then preferably implemented as a fourth step 4. Implementation of the correction may involve altering the DC and/or RF voltages applied to the quadrupole rod set mass filter/analyser.

Figure 3:
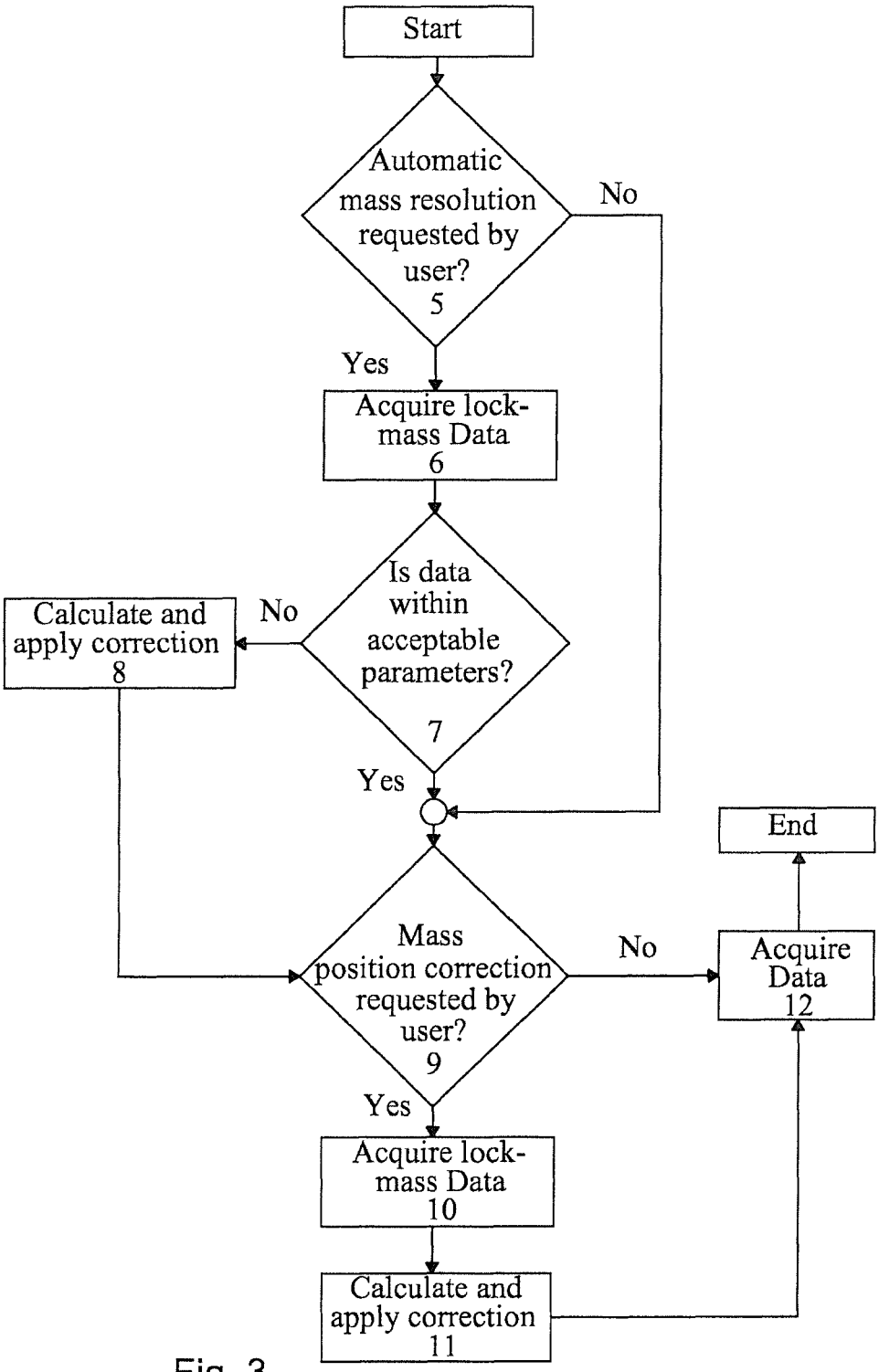
FIG. 3 shows a flow chart of a more complex mass resolution correction method wherein the mass or mass to charge ratio of the ions may also be recalibrated.

A further embodiment of the present invention will now be described with reference to FIG. 3. According to the preferred embodiment if a user requests automatic mass resolution correction 5, then lock mass data is preferably acquired 6. A determination is then made 7 as to whether or not the data is within acceptable parameters. In particular, a determination is made as to whether or not the resolution of ion or mass peaks observed in a mass spectrum or mass spectral data is sufficiently high. If the data is not within acceptable parameters then a mass resolution correction is calculated and applied 8 to the quadrupole rod set mass filter/analyser. If the data is within acceptable parameters then no mass resolution correction is calculated or applied to the quadrupole rod set mass filter/analyser. After the quadrupole mass filter/analyser has been automatically corrected (if applicable) to improve the mass resolution of the quadrupole mass filter/analyser, mass position correction (or mass accuracy) may then additionally be corrected for. Mass position (or mass accuracy) correction involves realigning or recalibrating the mass or mass to charge ratio axis of a mass spectrum or mass spectral data. According to the preferred embodiment if mass position correction has been requested by a user 9, then further lock mass data is acquired 10 and a mass position (or mass accuracy) correction is preferably calculated and applied 11 to the data. Once the quadrupole mass filter/analyser has been corrected for mass resolution drift and has optionally also been corrected for mass position or mass accuracy, then further experimental mass spectral data is then preferably acquired 12.

Although the present invention has been described with reference to the preferred embodiments, it will be understood by those skilled in the art that various changes in form and detail may be made without departing from the scope of the invention as set forth in the accompanying claims.

The invention claimed is:

1. A method of correcting mass or mass to charge ratio resolution drift of a quadrupole mass filter or mass analyser, said method comprising:

automatically measuring a parameter during an experimental acquisition; and automatically correcting the mass or mass to charge ratio resolution of said quadrupole mass filter or mass analyser one or more times during said experimental acquisition in response to said measured parameter;

wherein said parameter comprises an environmental parameter, temperature, humidity, ion current and/or space charge.

2. A method as claimed in claim 1, wherein said parameter comprises temperature and/or humidity.

3. A method as claimed in claim 1, wherein said parameter comprises a signal output from an electronic control unit.

4. A method as claimed in claim 1, wherein said step of automatically correcting the mass or mass to charge ratio resolution of said quadrupole mass filter or mass analyser comprises automatically altering a resolving DC offset voltage and/or a gain of said quadrupole mass filter or mass analyser.

5. A method as claimed in claim 1, wherein said step of automatically correcting the mass or mass to charge ratio resolution of said quadrupole mass filter or mass analyser comprises automatically altering the energy of ions passing to said quadrupole mass filter or mass analyser.

6. A method as claimed in claim 1, wherein said step of automatically correcting the mass or mass to charge ratio resolution of said quadrupole mass filter or mass analyser comprises automatically altering one or more voltages applied to a pre-filter arranged upstream of said quadrupole mass filter or mass analyser.

7. A method as claimed in claim 1, wherein said step of automatically correcting the mass or mass to charge ratio resolution of said quadrupole mass filter or mass analyser comprises automatically altering one or more voltages applied to a post-filter arranged downstream of said quadrupole mass filter or mass analyser.

8. A method as claimed in claim 1, further comprising acquiring mass spectral data during said experimental acquisition and correcting the mass position, mass accuracy or recalibrating or realigning the mass or mass to charge ratio of said mass spectral data.

9. A method as claimed in claim 8, wherein said step of correcting the mass position, mass accuracy or recalibrating or realigning the mass or mass to charge ratio of said mass spectral data is performed dynamically during said experimental acquisition and comprises automatically varying one or more voltages applied to said quadrupole mass filter or mass analyser.

10. A method as claimed in claim 8, wherein said step of correcting the mass position, mass accuracy or recalibrating or realigning the mass or mass to charge ratio of mass spectral data is performed as an automatic post-processing step.

11. A method as claimed in claim 8, further comprising acquiring further mass spectral data to confirm that the step of correcting the mass position, mass accuracy or recalibrating or realigning the mass or mass to charge ratio of mass spectral data was successful.

12. A method as claimed in claim 1, further comprising acquiring mass spectral data to confirm that the step of automatically correcting the mass or mass to charge ratio resolution of said quadrupole mass filter or mass analyser was successful.

13. A mass spectrometer comprising:

a quadrupole mass filter or mass analyser; and a control system arranged and adapted:

(i) to measure a parameter during an experimental acquisition; and (ii) to correct the mass or mass to charge ratio resolution of said quadrupole mass filter or mass analyser one or more times during said experimental acquisition in response to said measured parameter;

wherein said parameter comprises an environmental parameter, temperature, humidity, ion current and/or space charge.

14. A mass spectrometer as claimed in claim 13, wherein said parameter comprises temperature and/or humidity.

* * * * *